US005443304A

United States Patent [19]

Fochs

[11] Patent Number: 5,443,304

[45] Date of Patent: Aug. 22, 1995

[54] RESTRAINT FREE AMBULATION DEVICE

[75] Inventor: Arthur J. Fochs, Appleton, Wis.

[73] Assignee: Innovative Products Unlimited, Inc., Appleton, Wis.

[21] Appl. No.: 59,827

[22] Filed: May 7, 1993

[51] Int. Cl.[6] ..... A61H 3/00

[52] U.S. Cl. ..... 297/467; 297/5; 135/67

[58] Field of Search ..... 297/5, 6, 444.24, 115, 297/467, DIG. 4; 280/87.021; 135/67, 66, 65, 74

[56] References Cited

U.S. PATENT DOCUMENTS

| | | | |
|---|---|---|---|
| 1,890,396 | 12/1932 | Maphet | 297/5 |
| 2,129,260 | 9/1938 | Bowser | 297/5 X |
| 3,695,702 | 10/1972 | Ingellis | 297/441 |
| 4,342,465 | 8/1982 | Stillings | 280/87.02 W |
| 4,621,804 | 11/1986 | Mueller | 272/70.3 |
| 4,759,562 | 7/1988 | Vinyard et al. | 280/289 WC |
| 4,770,410 | 9/1988 | Brown | 272/70.3 |
| 4,953,851 | 9/1990 | Sherlock et al. | 272/70.3 |
| 4,995,412 | 2/1991 | Horn et al. | 135/67 |
| 5,012,963 | 5/1991 | Rosenbaum | 135/67 X |
| 5,058,912 | 10/1991 | Harroun | 280/87.021 |
| 5,083,806 | 1/1992 | Brown | 297/5 X |

*Primary Examiner*—Laurie K. Cranmer
*Attorney, Agent, or Firm*—Basile and Hanlon

[57] ABSTRACT

A combination chair and walker comprises a frame having laterally spaced apart front legs and rear legs spaced rearwardly thereof for movement over a floor in a stable, upright configuration. A seat has a forward edge spaced rearwardly of the front legs and defining an open space extending rearwardly of the front legs for accommodating a person's legs while in a standing, walking and sitting position. A mechanism, adjustably attached to the frame and selectively positionable, supports at least one of a person's side and arms. A frontal cross bar extends laterally between the adjustable side and arm support mechanism, the cross bar having one end portion pivotally connected to one side of the adjustable side and arm support mechanism to permit ingress and egress of the person from a front side of the chair/walker. A crotch strap is attached to the frame and extends between a person's legs into the open space, the strap being releasably attachable to the frontal cross bar while in a closed position. A lock secures the cross bar against unwanted pivotal and vertical movement while in the closed position for providing a firm hand rail for guiding the chair/walker.

15 Claims, 3 Drawing Sheets

RESTRAINT FREE AMBULATION DEVICE

BACKGROUND OF THE INVENTION

The present invention relates generally to ambulation devices, and more particularly to such a device which is virtually restraint free and aids in both walking and sitting of elderly and disabled persons.

Chair/walkers have been proposed which afford relatively easy ingress and egress and which provide a surrounding or enclosing safety frame system for minimizing the chances of a user falling or sliding and/or slipping off the seat to the floor. However, these chairs have not provided for any substantial side arm adjustment. As such, the side arms may be too low, and persons using the chair/walker may fall over the side. Further, the positioning of the side arms may be comfortable for sitting and/or standing, but not the reverse. Still further, the side arms may not allow use of a single chair by more than one person due to height and/or size differential. The known chair/walkers also generally do not provide for movable seats, whereby the seat may be moved rearward for ease while walking.

Thus, it is an object of the present invention to provide such a chair/walker having adjustable side arms. It is a further object of the present invention to provide such a chair/walker which optionally has a movable seat for further comfort.

SUMMARY OF THE INVENTION

The present invention addresses and solves the problems enumerated above. The present invention comprises a combination chair and walker for aiding the independent mobility of elderly or disabled persons in standing, walking and sitting. The chair/walker comprises a frame having laterally spaced apart front legs and rear legs spaced rearwardly of the front legs, the front and rear legs supporting the chair/walker for movement over a floor in a stable, upright configuration. Means for sitting are provided, the sitting means being supported from the frame at a predetermined sitting position, the sitting means having a forward edge spaced rearwardly of the front legs and defining an open space extending rearwardly of the front legs for accommodating a person's legs while in a standing, walking and sitting position. Means, disposed at a rearward portion of the frame, support a person's back area. Means, adjustably attached to the frame and selectively positionable, support at least one of a person's side and arms. A frontal cross bar, attached to, and extending laterally between the adjustable side and arm support means, supports at least one of a person's front side and arms and guides the chair/walker, the cross bar having one end portion pivotally connected to one side of the adjustable side and arm support means for pivotal movement toward an open position extending upwardly when an opposite end portion of the cross bar is disconnected from an opposite side of the adjustable side and arm support means, to permit ingress and egress of the person from a front side of the chair/walker. A crotch strap is attached to the frame and extends between a person's legs into the open space, the strap being releasably attachable to the frontal cross bar while in a closed position. Means, cooperable with the opposite side of the adjustable side and arm support means, lock the cross bar against unwanted pivotal and vertical movement while in the closed position and provide a firm hand rail for guiding the chair/walker when secured to extend between the adjustable side and arm support means.

BRIEF DESCRIPTION OF THE DRAWINGS

Other objects, features and advantages of the present invention will become apparent by reference to the following detailed description and drawings, in which.

DESCRIPTION OF THE PREFERRED EMBODIMENT

Figure 1:
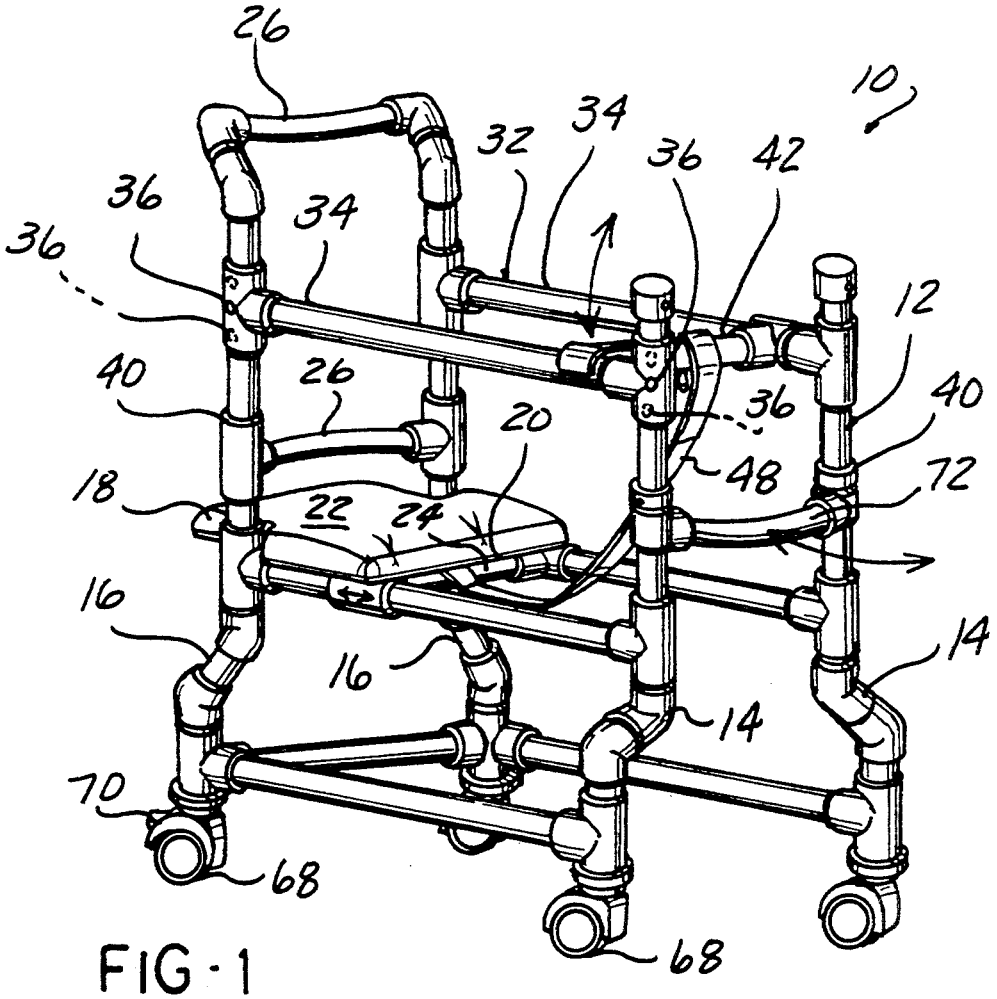
FIG 1 is a perspective view of the chair/walker of the present invention.

Referring now to FIG. 1, the combination chair/walker of the present invention is designated generally as 10. The chair/walker 10 aids in the independent mobility of elderly or disabled persons in standing, walking and sitting. Chair/walker 10 comprises a frame 12 having laterally spaced apart front legs 14 and rear legs 16 spaced rearwardly of front legs 14, the front 14 and rear 16 legs supporting the chair/walker for movement over a floor in a stable upright configuration. Legs 14 and 16 may be of any suitable size, shape and material, however, preferably they are as shown most clearly in FIG. 1, wherein the front legs 14 are stepped outward to the side, and wherein the back legs 16 are angularly stepped outward; this configuration aids in greater chair/walker stability.

Figure 3:
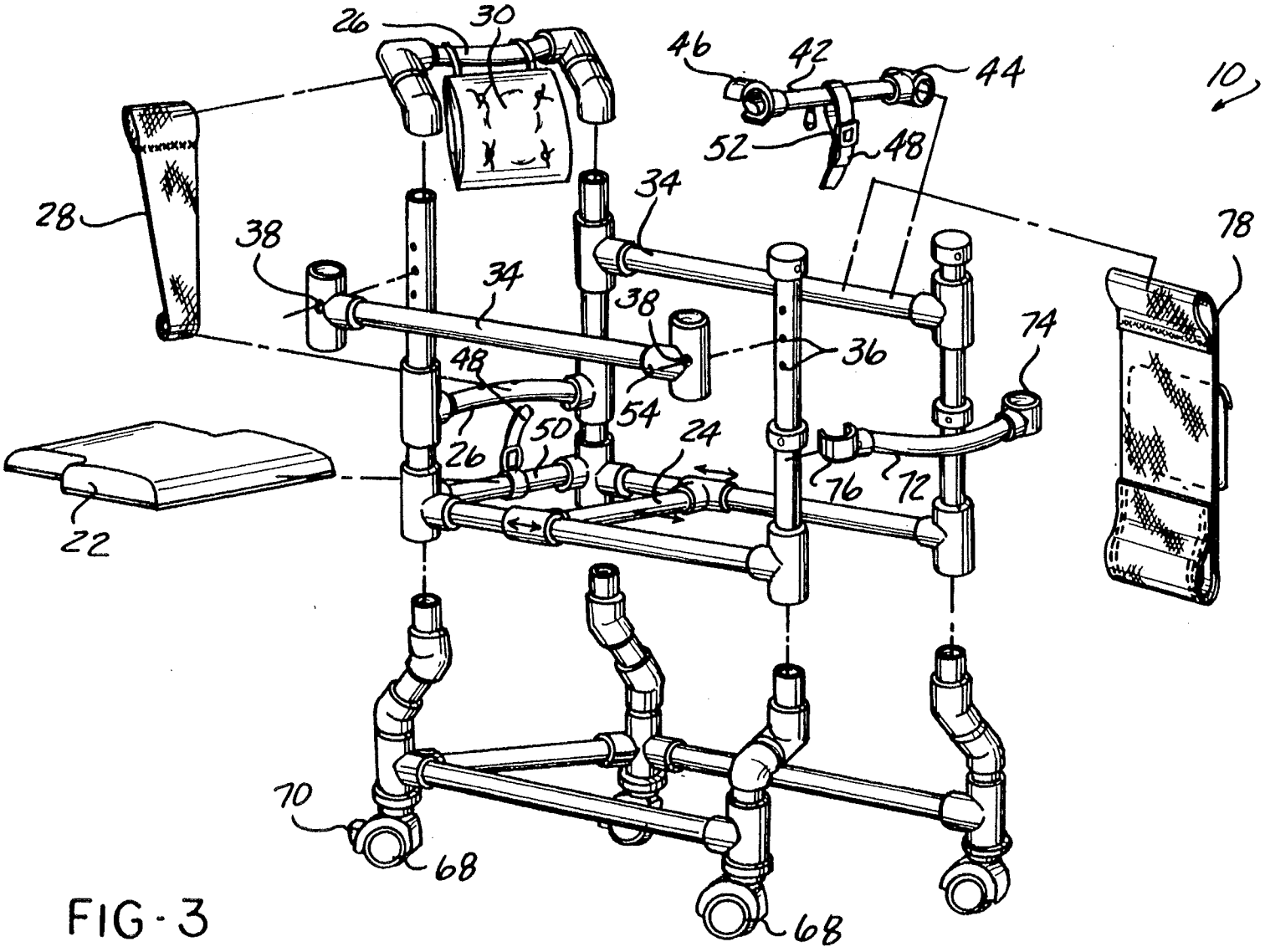
FIG. 3 is an exploded perspective view of the present invention.

The chair/walker 10 further comprises means 18 for sitting, the sitting means 18 being supported from frame 12 at a predetermined sitting position, sitting means 18 having a forward edge 20 spaced rearwardly of the front legs 14 and defining an open space extending rearwardly of front legs 14 for accommodating a person's legs while in a standing, walking and sitting position. It is to be understood that the sitting means 18 may comprise any suitable means, however, in the preferred embodiment this means comprises a seat 22 attached to a lateral bar 24 mounted on frame 12. As shown in FIGS. 1 and 3, this lateral bar 24 is slidably mounted for sliding forward and rearward movement. In this manner, the seat 22 may be pushed into a fully rearward position for greater ease in walking (as shown in FIG. 1), or a fully forward position for comfortable sitting, or any intermediate position therebetween. It is to be further understood that the seat may be fixedly mounted upon frame 12.

The chair/walker further comprises means 26, disposed at a rearward portion of frame 12, for supporting a person's back area. This back support means 26 may comprise any suitable means, however, as shown in FIG. 1, this back support means 26 comprises two cylindrical bars extending laterally across the frame 12 at predetermined back support positions. As shown in FIG. 3, this back support means may further optionally comprise flexible support netting 28 releasably secured at opposite ends around cylindrical bars 26. Further optionally included is a back rest pillow 30 releasably secured about the uppermost cylindrical bar 26.

Figure 4C:
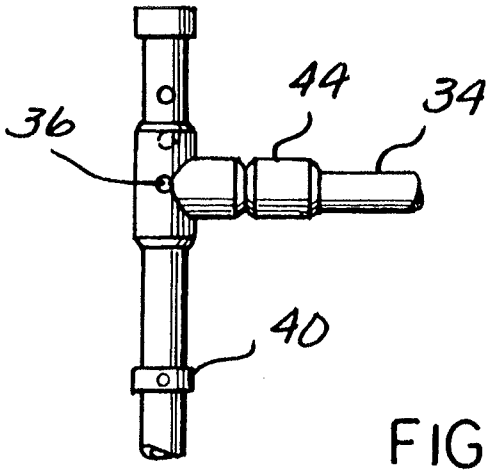
FIGS. 4A–4D show the four side arm positions.
Figure 4D:
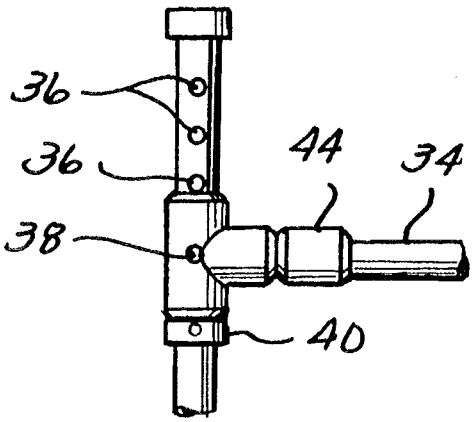
Figure 4A:
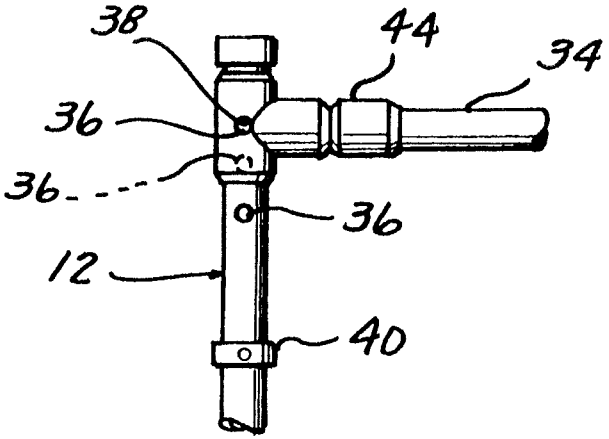
Figure 4B:
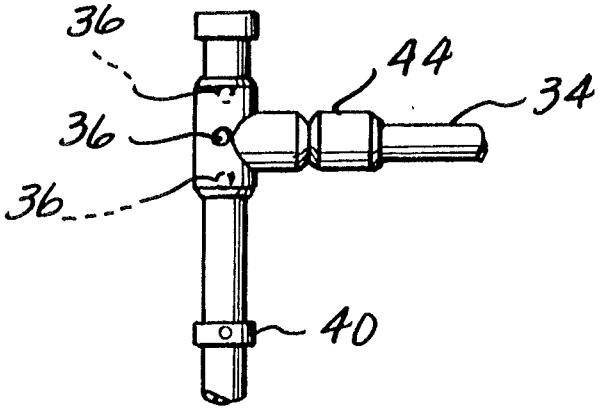

Chair/walker 10 further comprises means 32, adjustably attached to frame 12 and selectively positionable, for supporting at least one of a person's side and arms. This adjustable side and arm support means may be positioned such that the person can lean against it for side support, the person may use it for an arm support, or the person may Use it during walking for support and for guiding the chair/walker. Further, this adjustment may be utilized to accommodate persons of varying heights and sizes, thereby lending great versatility to the present invention. It is to be understood that this means 32 may comprise any suitable means, including any such suitable means which may or may not be height adjustable. However, in the preferred embodiment, means 32 comprises two cylindrical side arms 34, each slidably mounted at opposite ends on frame 12, as best seen in FIGS. 1 and 3. The selective positioning may be achieved by any suitable means, however, in the preferred embodiment it is achieved by a plurality of spring biased detent pins 36 receivable within through bores 38, and a stop means 40. Any number of positions may be achieved, but in the preferred embodiment, and as shown in the figures, four positions are possible, as best seen in FIGS. 4A–4D. As shown in FIG. 4A, side arm 34 (only one of which is shown; it is to be understood that the positioning is similar on both sides 34) is in its upper most position. The upper most spring biased detent pin 36 is lockingly received through bore 38. In order to move to the next lower position as shown in FIG. 4B, detent pin 36 is pushed inward and disengages from throughbore 38, side arm 34 is pushed down until the next lowest detent pin 36 snaps into place within throughbore 38. This procedure is repeated to move from the position show in FIG. 4B to that shown in FIG. 4C, wherein the lower most detent pin 36 is engaged within throughbore 38. In a similar manner, arm 34 is moved from the position shown in FIG. 4C to the position shown in FIG. 4D, except, in this lower most position, no detent pin 36 is engaged within throughbore 38; rather, arm 34 is stopped by a stop means 40. In this manner, the adjustable side and arm support means 32 may be selectively and lockingly moved between one of four various positions.

Figure 2:
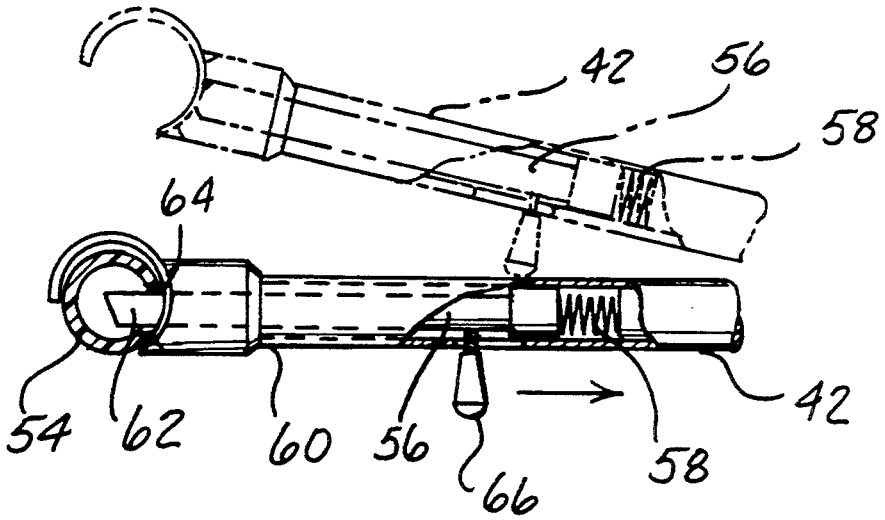
FIG. 2 is an enlarged side view of the frontal cross bar.

Chair/walker 10 may further comprise a frontal cross-bar 42, attached to, and extending laterally between the adjustable side and arm support means 32, for supporting at least one of a person's front side and arm and for guiding the chair/walker. In this way, a person can use bar 42 for frontal support and/or for arm support. Cross-bar 42 has one end portion 34 pivotally connected to one side of the adjustable side and arm support means 32 for pivotal movement about a horizontal axis toward an open position extending upwardly when an opposite end portion 46 of cross-bar 42 is disconnected from an opposite side of the adjustable side and arm support means. The closed position of cross-bar 42 is shown in FIG. 2, and an open position is shown in phantom in FIG. 2. The opening of cross-bar 42 permits ingress and egress of the person from a front side of chair/walker 10.

The present invention may further optionally comprise a crotch strap 48 attached to frame 12 and extending between a person's legs into the open space, strap 48 being releasably attachable to frontal cross-bar 42 while in a closed position. Crotch strap 48 may be attached to the frame in any suitable manner, however, in the preferred embodiment, as best seen in FIG. 3, one end of strap 48 is attached to a rear most lateral bar 50 of frame 12. The releasable attaching means may comprise any suitable means, however, in the preferred embodiment one end of the strap 48 is looped over bar 42, that one end having a female half of a quick release buckle attachment 52 and is releasably secured within a male half of the quick release buckle attachment 52 in a known manner.

The chair/walker may further comprise means, cooperable with the opposite side 54 of the adjustable side and arm support means 32, for locking crossbar 42 against unwanted pivotal and vertical movement while in the closed position for providing a firm hand rail for guiding chair/walker 10 once secured to extend between the adjustable side and arm support means 32. This locking means may comprise any suitable means. However, in the preferred embodiment, this locking means comprises a manually slidable member 56 biased into a closed position as shown in solid line in FIG. 2, by a spring 58. Member 56 and spring 58 are operatively contained within hollow cylindrical sleeve 60. Projecting end 62, when in the locked position, is received within receiving bore 64 in the opposite side 54 of the adjustable side and arm support means 32. In order to unlock crossbar 42, knob 66 is pushed to the right as shown in FIG. 2, thereby retracting projecting end 62 out of bore 64, thereby allowing crossbar 42 to be moved pivotally upward and outward.

In order to facilitate free and easy movement, rollers 68 may be provided, and optional roller locking means 70 may also be provided on one or all rollers 68.

For further support and frame integrity, a second frontal crossbar 72 may optionally be attached to frame 12. As seen in FIGS. 1 and 3, this second crossbar 72 is located at an upper end of front legs 14 and is pivotally connected at one end 74 to frame 12 and is pivotal outward in the direction of the arrow shown in FIG. 1 in a gate-like manner. The opposite end 76 of second frontal crossbar 72 is securely but releasably snap fit on frame 12. It is to be understood that the pivotal attachment and releasable securing means of second frontal crossbar 72 may be any suitable means; however, the preferred means is that described immediately above.

A further optional component of the chair/walker is tote means 78 which is releasably attachable, as by Velcro, snaps or the like, to one of the side arms 34. Tote means 78 may be of any suitable size and configuration to carry anything desired by the user. It is to be understood that any number of tote means may be used, and they may be attached in any suitable and appropriate area which would not interfere with ambulation.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position;

means, disposed at a rearward portion of the frame, for supporting a person's back area;

means, adjustably attached to the frame and selectively positionable, for supporting at least one of a person's side and arms, wherein the adjustable side and arm support means is adjustable relative to the sitting means, and wherein the adjustable side and arm support means comprises:

two opposed side arms, each having forward and rearward ends;

a hollow sleeve extending substantially perpendicularly to, and attached to each of the side arm forward and rearward ends, each of the sleeves having a through bore therethrough and slidably attached on the frame; and a plurality of spring biased detent pins, one of which is releasably receivable through a respective through bore, the detent pins positioned to selectively allow a plurality of side arm positions;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position; and means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means.

2. The chair/walker as defined in claim 1, wherein the adjustable side and arm support means further comprises:

a stop means, for preventing the side arms from passing a lowermost position.

3. The chair/walker as defined in claim 2 wherein the detent pins allow an uppermost position, and a lowermost position.

4. The chair/walker as defined in claim 3 wherein the detent pins allow two intermediate positions.

5. The chair/walker as defined in claim 1, further comprising a plurality of rollers at floor contacting ends of the front and rear legs.

6. The chair/walker as defined in claim 1, further comprising means, releasably attached to the frame, for toting articles.

7. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position, wherein the sitting means is selectively movable between a forward, sitting position, a rear, walking position, and an intermediate position therebetween;

means, disposed at a rearward portion of the frame, for supporting a person's back area;

means, adjustably attached to the frame and selectively positionable, for supporting at least one of a person's side and arms;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position; and means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means.

8. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly by of the front legs for accommodating a person's legs while in a standing, walking and sitting position;

means, disposed at a rearward portion of the frame, for supporting a person's back area;

means, adjustably attached to the frame and selectively positionable, for supporting at least one of a person's side and arms;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position;

means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means; and a second frontal cross bar laterally attached to the frame at an upper end of the front legs, pivotally connected at one end thereof to one front leg, and releasably snap fit at an opposite end thereof to an opposite front leg, the second frontal cross bar pivotable outward in a gate-like manner.

9. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position, the sitting means being selectively movable between a forward, sitting position, a rear, walking position, and an intermediate position therebetween;

means, disposed at a rearward portion of the frame, for supporting a person's back area;

means, adjustably attached to the frame and selectively positionable, for supporting at least one of a person's side and arms, wherein the adjustable side and arm support means comprises:

two opposed side arms, each slidably attached on the frame at forward and rearward ends thereof, each of the forward and rearward ends of the side arms having a through bore therethrough;

a plurality of spring biased detent pins, one of which is releasably receivable through a respective through bore, the detent pins positioned to selectively allow a plurality of side arm positions; and a stop means, for preventing the side arms from passing a lowermost position;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position;

means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means;

a second frontal cross bar laterally attached to the frame at an upper end of the front legs, pivotally connected at one end thereof to one front leg, and releasably snap fit at an opposite end thereof to an opposite front leg, the second frontal cross bar pivotable outward in a gate-like manner; and a plurality of rollers at floor contacting ends of the front and rear legs.

10. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position, wherein the sitting means is selectively movable between a forward, sitting position, and a rear, walking position;

means, disposed at a rearward portion of the frame, for supporting a person's back area;

means, attached to the frame, for supporting at least one of a person's side and arms;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position; and means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means.

11. The chair/walker as defined in claim 10 wherein the sitting means is further movable to an intermediate position between the sitting position and the walking position.

12. The chair/walker as defined in claim 10 wherein the side and arm support means is adjustably attached to the frame and selectively positionable.

13. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position, wherein the sitting means is selectively movable between a forward, sitting position, and a rear, walking position;

means, disposed at a rearward portion of the frame, for supporting a person's back area;

means, adjustably attached to the frame and selectively positionable, for supporting at least one of a person's side and arms, wherein the adjustable side and arm support means comprises:

two opposed side arms, each having forward and rearward ends;

a hollow sleeve extending substantially perpendicularly to, and attached to each of the side arm forward and rearward ends, each of the sleeves having a through bore therethrough and slidably attached on the frame; and a plurality of spring biased detent pins, one of which is releasably receivable through a respective through bore, the detent pins positioned to selectively allow a plurality of side arm positions;

a frontal cross bar, attached to, and extending laterally between the adjustable side and arm support means, for supporting at least one of a person's front side and arms and for guiding the chair/-walker, the cross bar having one end portion pivotally connected to one side of the adjustable side and arm support means for pivotal movement about a horizontal pivot axis toward an open position extending upwardly from the pivot axis when an opposite end portion of the cross bar is disconnected from an opposite side of the adjustable side and arm support means, to permit ingress and egress of the person from a front side of the chair/-walker;

a crotch strap attached to the frame and extending between a person's legs into the open space, the strap being releasably attachable to the frontal cross bar while in a closed position; and means, cooperable with the opposite side of the adjustable side and arm support means, for locking the cross bar against unwanted pivotal and vertical movement while in the closed position for providing a firm hand rail for guiding the chair/walker when secured to extend between the adjustable side and arm support means.

14. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting, the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position;

means, disposed at a rearward portion of the frame, for supporting a person's back area;

means, adjustably attached to the frame and selectively positionable, for supporting at least one of a person's side and arms, wherein the adjustable side and arm support means is adjustable relative to the sitting means, and wherein the adjustable side and arm support means comprises:

two opposed side arms, each having forward and rearward ends;

a hollow sleeve extending substantially perpendicularly to, and attached to each of the side arm forward and rearward ends, each of the sleeves having a through bore therethrough and slidably attached on the frame; and a plurality of spring biased detent pins, one of which is releasably receivable through a respective through bore, the detent pins positioned to selectively allow a plurality of side arm positions;

a frontal cross bar, attached to, and extending laterally between the adjustable side and arm support means, for supporting at least one of a person's front side and arms and for guiding the chair/-walker, the cross bar selectively positionable between an opened and a closed position, to permit ingress and egress of the person from a front side of the chair/walker;

a crotch strap attached to the frame and extending between a person's legs into the open space, the strap being releasably attachable to the frontal cross bar while in a closed position; and means, cooperable with the adjustable side and arm support means, for locking the cross bar against unwanted pivotal and vertical movement while in the closed position for providing a firm hand rail for guiding the chair/walker when secured to extend between the adjustable side and arm support means.

15. A combination chair and walker for aiding the independent mobility of elderly or disabled persons in standing, walking and sitting, the chair/walker comprising:

a frame, comprising:

laterally spaced apart front legs; and rear legs spaced rearwardly of the front legs, the front and rear legs supporting the chair/walker for movement over a floor in a stable, upright configuration;

means for sitting, the sitting means being supported from the frame at a predetermined sitting position, the sitting means having a forward edge spaced rearwardly of the front legs and defining an open space extending rearwardly of the front legs for accommodating a person's legs while in a standing, walking and sitting position, wherein the sitting means is selectively movable between a forward, sitting position, and a rear, walking position;

means, disposed at a rearward portion of the frame, for supporting a person's back area;

means, adjustably attached to the frame and selectively positionable, for supporting at least one of a person's side and arms, wherein the adjustable side and arm support means comprises:

two opposed side arms, each having forward and rearward ends;

a hollow sleeve extending substantially perpendicularly to, and attached to each of the side arm forward and rearward ends, each of the sleeves having a through bore therethrough and slidably attached on the frame; and a plurality of spring biased detent pins, one of which is releasably receivable through a respective through bore, the detent pins positioned to selectively allow a plurality of side arm positions;

a frontal cross bar, attached to, and extending laterally between the adjustable side and arm support means, for supporting at least one of a person's front side and arms and for guiding the chair/walker, the cross bar selectively positionable between an opened and a closed position, to permit ingress and egress of the person from a front side of the chair/walker;

a crotch strap attached to the frame and extending between a person's legs into the open space, the strap being releasably attachable to the frontal cross bar while in a closed position; and means, cooperable with the adjustable side and arm support means, for locking the cross bar against unwanted pivotal and vertical movement while in the closed position for providing a firm hand rail for guiding the chair/walker when secured to extend between the adjustable side and arm support means.

* * * * *

UNITED STATES PATENT AND TRADEMARK OFFICE

CERTIFICATE OF CORRECTION

PATENT NO. : 5,443,304
DATED : August 22, 1995
INVENTOR(S) : Arthur J. Fochs

It is certified that error appears in the above-indentified patent and that said Letters Patent is hereby corrected as shown below:

Column 3, line 3, delete "Use" and insert --use--.

Column 3, line 27, delete "throughbore" and insert --through bore--.

Column 3, line 43, delete "arm" and insert --arms--.

Column 3, line 46, delete "34" and insert --44--.

Column 4, line 6, delete "crossbar" and insert --cross bar--.

Column 6, line 61, delete "by".

Signed and Sealed this
Fourth Day of June, 1996

Bruce Lehman

*Attest:*

BRUCE LEHMAN

*Attesting Officer*

*Commissioner of Patents and Trademarks*